US010566727B2

(12) United States Patent
Huang et al.

(10) Patent No.: US 10,566,727 B2
(45) Date of Patent: Feb. 18, 2020

(54) ELECTRICAL CONNECTOR AND CONDUCTIVE TERMINAL THEREOF

(71) Applicant: CHENG UEI PRECISION INDUSTRY CO., LTD., New Taipei (TW)

(72) Inventors: Sheng-Yuan Huang, New Taipei (TW); Han-Wei Wang, New Taipei (TW); Te-Hung Yin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/243,064

(22) Filed: Jan. 8, 2019

(65) Prior Publication Data

US 2019/0334275 A1 Oct. 31, 2019

(30) Foreign Application Priority Data

Apr. 27, 2018 (TW) ..... 107205568 U

(51) Int. Cl.
*H01R 13/428* (2006.01)
*H01R 12/72* (2011.01)

(52) U.S. Cl.
CPC ..... *H01R 13/428* (2013.01); *H01R 12/721* (2013.01)

(58) Field of Classification Search
CPC .... H01R 12/721; H01R 12/724; H01R 13/26; H01R 13/41
USPC ..... 439/637, 733.1
See application file for complete search history.

(56) References Cited

U.S. PATENT DOCUMENTS 7,442,089 B2 * 10/2008 Regnier ..... H01R 13/26 439/637
7,445,502 B2 * 11/2008 Zhang ..... H01R 13/658 439/607.01
7,611,361 B2 * 11/2009 Kondo ..... H01R 13/42 439/733.1
7,744,431 B2 * 6/2010 Trout ..... H01R 13/112 439/733.1
8,147,277 B1 * 4/2012 Wang ..... H01R 24/62 439/541.5
2013/0309906 A1 * 11/2013 De Geest ..... H01R 13/6477 439/607.31

(Continued)

*Primary Examiner* — Tulsidas C Patel
*Assistant Examiner* — Marcus E Harcum
(74) *Attorney, Agent, or Firm* — Cheng-Ju Chiang

(57) ABSTRACT

An electrical connector includes an insulating housing and a plurality of first terminals. A front surface of the insulating housing is recessed rearward to form an insertion space. The insulating housing opens a plurality of first terminal grooves. The insulating housing defines a plurality of upper adjusting slots. The plurality of first terminals are disposed in the plurality of the first terminal grooves. Each of the plurality of the first terminals has a first fastening portion and a first contact portion. A rear end of the first fastening portion extends downward to form an adjusting portion which opens an opening. The first fastening portions of the plurality of the first terminals are assembled in the plurality of the upper adjusting slots. The first contact portions of the plurality of the first terminals are assembled in the plurality of the first terminal grooves and project downward into the insertion space.

19 Claims, 8 Drawing Sheets

(56) References Cited

U.S. PATENT DOCUMENTS

| | | | | |
|---|---|---|---|---|
| 2014/0106630 | A1* | 4/2014 | Oyake | H01R 13/6467 439/884 |
| 2014/0235108 | A1* | 8/2014 | Shiratori | H01R 13/652 439/660 |
| 2014/0378002 | A1* | 12/2014 | Hung | H01R 12/721 439/637 |
| 2015/0140866 | A1* | 5/2015 | Tsai | H01R 12/724 439/637 |
| 2015/0200501 | A1* | 7/2015 | Yang | H01R 24/60 439/676 |

* cited by examiner

ELECTRICAL CONNECTOR AND CONDUCTIVE TERMINAL THEREOF

CROSS-REFERENCE TO RELATED APPLICATION

The present application is based on, and claims priority form, Taiwan Patent Application No. 107205568, filed Apr. 27, 2018, the disclosure of which is hereby incorporated by reference herein in its entirety.

BACKGROUND OF THE INVENTION

1. Field of the Invention

The present invention generally relates to a connector, and more particularly to an electrical connector and a conductive terminal thereof.

2. The Related Art

With the increase of networks and communication requirements day by day, cloud computing and storage which are required by industry are growing rapidly. Data center is in a trend of developing continually, so requirements of transmission speeds of data communications and data storage applied among devices continue increasing. The transmission speed has developed from 2.5 Gbps, 5 Gbps of past every passageway to 10 Gbps and even 28 Gbps of current every passageway, so a signal transmission integrity requirement of a connector is promoted continuously. From a circuit board to conductive terminals surrounded by an insulating housing, parameters of convergence adjustments of impedance consistency, insertion losses, return losses, signal delays and so on are several obvious indexes which affect performances of the connector.

Referring to FIG. 8, a conventional electrical connector 100' is a quad small form-factor pluggable (QSFP) electrical connector. The conventional electrical connector 100' includes an insulating housing 10', a plurality of first terminals 20' and a plurality of second terminals 30'. The insulating housing 10' is an integrally molded component. A middle of a front surface of the insulating housing 10' is recessed rearward to form an insertion space 11'. Several portions of a bottom surface of a top wall of the insertion space 11' are recessed upward to form a plurality of first terminal grooves 13' penetrating through the top wall of the insertion space 11' and arranged transversely. Rear ends of the plurality of first terminal grooves 13' extend rearward and penetrate through a rear surface of the insulating housing 10' to form a plurality of upper adjusting slots 131'. A top surface of a bottom wall of each of the plurality of upper adjusting slots 131' is recessed downward to form a first fixing slot 132'. A rear end of the insulating housing 10' protrudes rearward to form a rear portion 14'. Several portions of a rear surface of the rear portion 14' are recessed frontward to form a plurality of first rear adjusting slots 143'. The rear portion 14' opens a plurality of lacking grooves 141' located to tops of the plurality of first rear adjusting slots 143'.

Each of the plurality of first terminals 20' has a first fastening portion 21', and a first contact portion 22' connected with a front edge of the first fastening portion 21'. The first contact portion 22' has a first elastic arm 221' extended frontward and downward from the front edge of the first fastening portion 21'. A tail end of the first elastic arm 221' is connected with a first contact arm 222' extending frontward and upward. A bottom end of the first fastening portion 21' has a first fixing portion 23' extending downward. A rear end of the first fastening portion 21' extends rearward and downward, and then extends downward to form an adjusting portion 24'. A bottom end of the adjusting portion 24' extends downward and then extends rearward to form a first soldering portion 26'. The first fastening portions 21' of the plurality of first terminals 20' are assembled in the plurality of the upper adjusting slots 131'. The first contact portions 22' of the plurality of first terminals 20' are assembled in the plurality of the first terminal grooves 13' and are inserted downward into the insertion space 11'. Bottom ends of the adjusting portions 24' of the plurality of first terminals 20' are assembled in the plurality of first rear adjusting slots 143'. The first soldering portions 26' of the plurality of the first terminals 20' project downward out of a rear end of a bottom surface of the rear portion 14'.

Referring to FIG. 5 to FIG. 7, an impedance simulation wave graph of each of the plurality of the first terminals 20' of the conventional electrical connector 100' in prior art is shown. A wave graph of simulating insertion losses of the conventional electrical connector 100' is shown. A wave graph of simulating return losses of the conventional electrical connector 100' is shown. However, scopes of input impedances and output impedances of the conventional electrical connector 100' will exceed a scope specified by the conventional electrical connector 100', and a difference between the input impedance and the output impedance is 10Ω. As a result, the conventional electrical connector 100' has no way of having a steady high frequency effect.

Thus, an innovative electrical connector and a conductive terminal of the innovative electrical connector are essential to be provided to make impedances of the conductive terminal conforms to a scope specified by the QSFP electrical connector, and insertion losses and return losses of the innovative electrical connector are optimized, so that the innovative electrical connector is capable of having a stabler and more effective electrical characteristic.

SUMMARY OF THE INVENTION

An object of the present invention is to provide an electrical connector. The electrical connector includes an insulating housing and a plurality of first terminals. A middle of a front surface of the insulating housing is recessed rearward to form an insertion space. The insulating housing opens a plurality of first terminal grooves penetrating through a top of the insulating housing and arranged transversely. The insulating housing defines a plurality of upper adjusting slots penetrating through a rear surface of the insulating housing and located behind the plurality of the first terminal grooves. Each of the plurality of the upper adjusting slots is corresponding to one of the plurality of the first terminal grooves. A bottom of each of the plurality of the upper adjusting slots extends downward to form a first fixing slot. The plurality of the first terminal grooves are communicated between the insertion space and an outside. A lower portion of the rear surface of the insulating housing protrudes rearward to form a rear portion. Several portions of a rear surface of the rear portion are recessed frontward to form a plurality of first adjusting channels arranged transversely. The plurality of first terminals are disposed in the plurality of the first terminal grooves and arranged transversely. Each of the plurality of the first terminals has a first fastening portion, and a first contact portion connected with a front end of the first fastening portion. A bottom of the first fastening portion protrudes downward to form a first fixing portion. A rear end of the first fastening portion extends downward to form an adjusting portion. The adjusting portion opens an opening. A tail end of the adjusting portion extends rearward to form a first soldering portion. The first fastening portions of the plurality of the first terminals are assembled in the plurality of the upper adjusting slots. The first fixing portion of each of the plurality of the first terminals is fixed in the first fixing slot. The first contact portions of the plurality of the first terminals are assembled in the plurality of the first terminal grooves and project downward into the insertion space. Bottom ends of the adjusting portions of the plurality of the first terminals are assembled in the plurality of the first adjusting channels. The first soldering portions of the plurality of the first terminals are exposed downward beyond a rear end of a bottom surface of the rear portion.

Another object of the present invention is to provide a conductive terminal of an electrical connector. The conductive terminal is fastened in the electrical connector. The conductive terminal includes a first fastening portion, a first contact portion connected with a front end of the first fastening portion, an adjusting portion, and a first soldering portion extended rearward from a tail end of the adjusting portion. A bottom of the first fastening portion protrudes downward to form a first fixing portion. The adjusting portion is extended downward, then slantwise extended downward and rearward and further extended downward from a rear end of the first fastening portion. The adjusting portion opens an opening.

Another object of the present invention is to provide an electrical connector. The electrical connector includes an insulating housing, a plurality of first terminals arranged transversely in the insulating housing, and a plurality of second terminals arranged transversely in the insulating housing. A middle of a front surface of the insulating housing is recessed rearward to form an insertion space. Each of the plurality of the first terminals has a first fastening portion received in the insulating housing, a first contact portion connected with a front end of the first fastening portion and arranged at one side of the insertion space, an adjusting portion extended downward from a rear end of the first fastening portion, and a first soldering portion extended rearward from a tail end of the adjusting portion and exposed out of the insulating housing. The adjusting portion opens an opening. Each of the plurality of the second terminals has a second fastening portion received in the insulating housing, a second contact portion connected with a front end of the second fastening portion and arranged at the other side of the insertion space, and a second soldering portion extended from a rear end of the second fastening portion and exposed out of the insulating housing.

As described above, because the adjusting portions of the plurality of the first terminals of the electrical connector are designed to open the openings, impedances of the plurality of the first terminals conform to a scope specified by the electrical connector which is the quad small form-factor pluggable electrical connector through simulation results of high-frequency analyses, and insertion losses and return losses of the electrical connector are optimized, so that the electrical connector is capable of passing through a high-frequency requirement, and having a stabler and more effective electrical characteristic.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
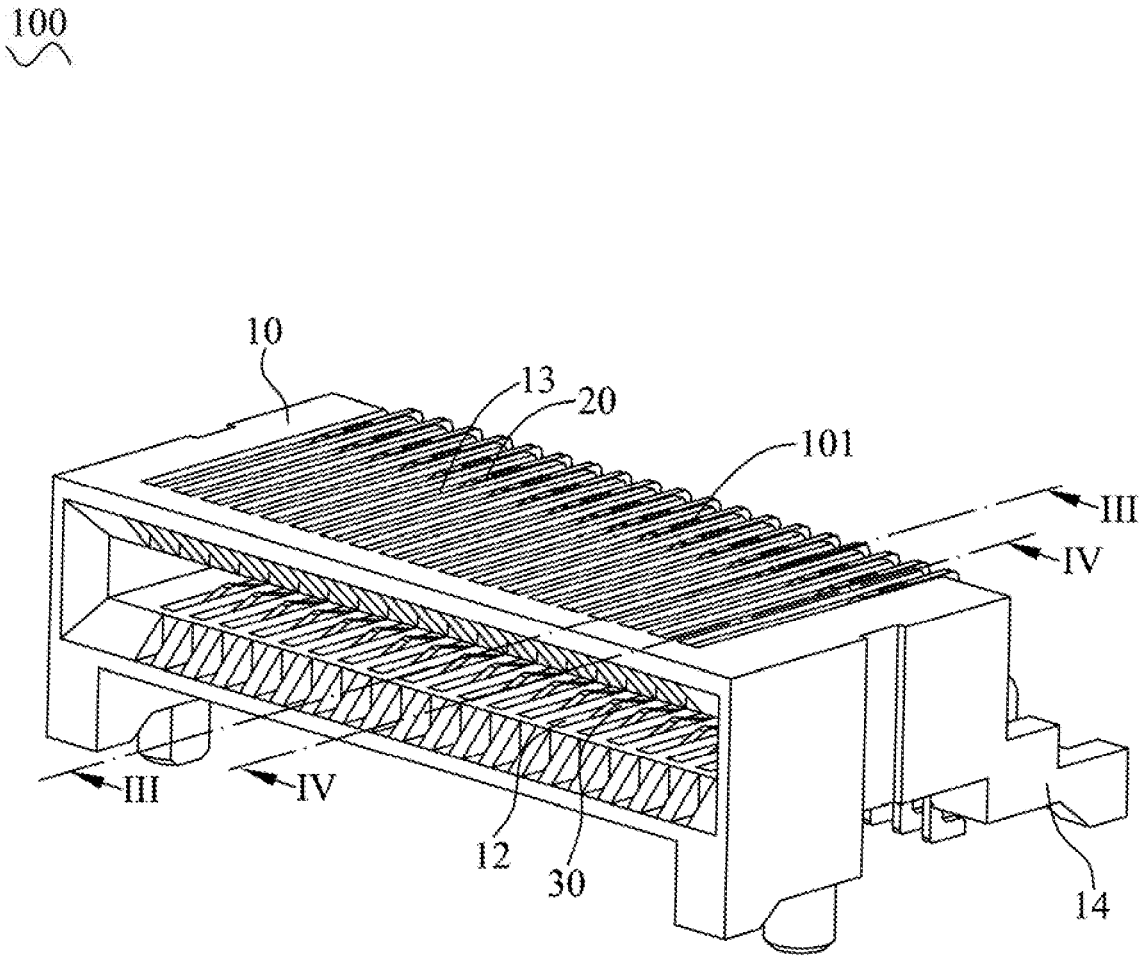
FIG. 1 is a perspective view of an electrical connector in accordance with the present invention.
Figure 2:
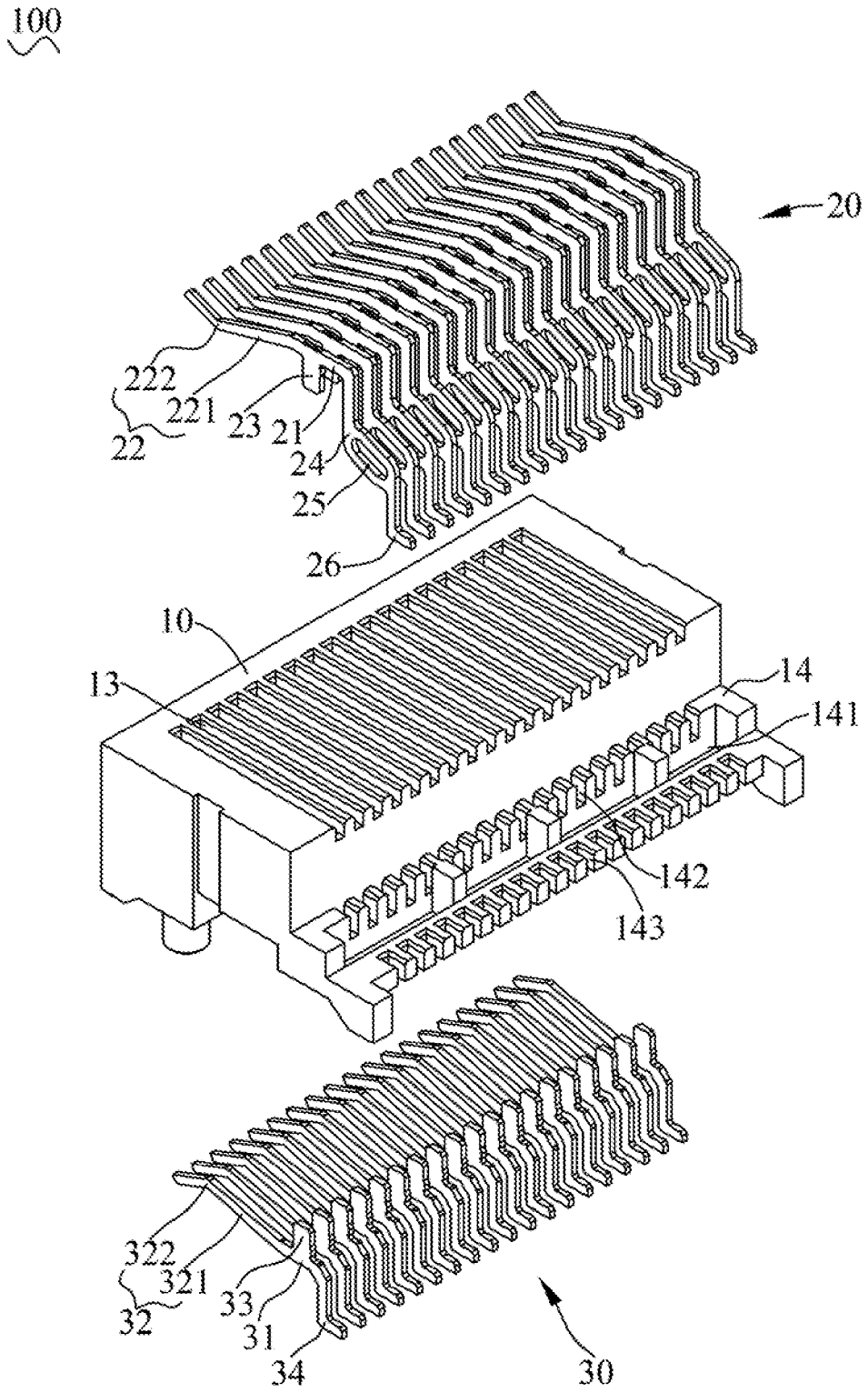
FIG. 2 is an exploded view of the electrical connector of FIG. 1.
Figure 3:
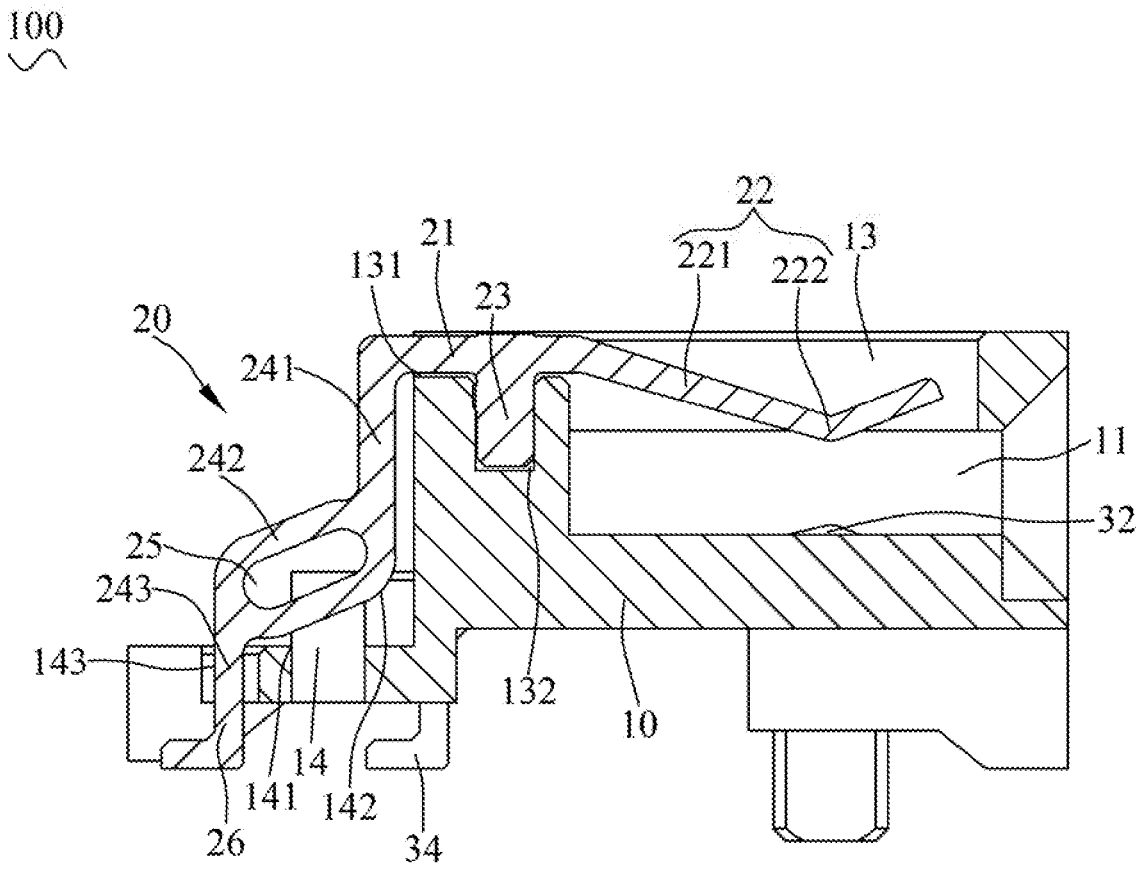
FIG. 3 is a cross-sectional view of the electrical connector of FIG. 1 along a line of FIG. 1.
Figure 4:
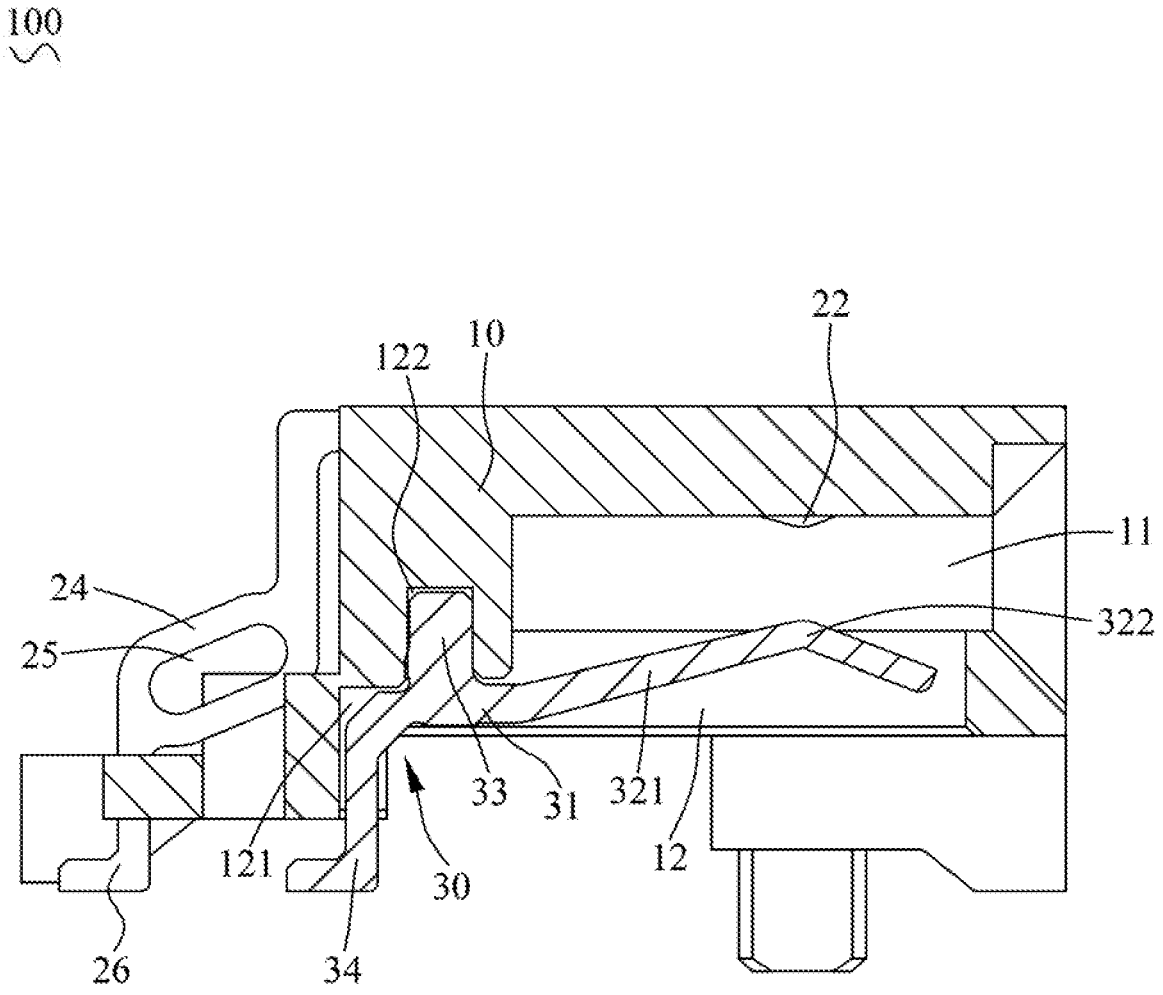
FIG. 4 is a cross-sectional view of the electrical connector of FIG. 1 along a line IV-IV of FIG. 1.

With reference to FIG. 1 and FIG. 2, an electrical connector 100 in accordance with the present invention is shown. The electrical connector 100 is a quad small form-factor pluggable (QSFP) electrical connector. The electrical connector 100 includes an insulating housing 10 and a plurality of conductive terminals 101. The plurality of the conductive terminals 101 include a plurality of first terminals 20 and a plurality of second terminals 30.

Referring to FIG. 1 to FIG. 4, the insulating housing 10 is an integrally molded component. A middle of a front surface of the insulating housing 10 is recessed rearward to form an insertion space 11. The insulating housing 10 opens a plurality of first terminal grooves 13 penetrating through a top of the insulating housing 10 and arranged transversely, and a plurality of second terminal grooves 12 penetrating through a bottom of the insulating housing 10 and arranged transversely. The plurality of the first terminal grooves 13 are communicated between the insertion space 11 and an outside. The insulating housing 10 defines a plurality of upper adjusting slots 131 penetrating through a rear surface of the insulating housing 10 and located behind the plurality of the first terminal grooves 13. Each of the plurality of the upper adjusting slots 131 is corresponding to one of the plurality of the first terminal grooves 13. The insulating housing 10 defines a plurality of inverted L-shaped lower adjusting slots 121 penetrating through a bottom surface of the insulating housing 10 and located behind the plurality of the second terminal grooves 12.

Specifically, a top wall of the insertion space 11 opens the plurality of the first terminal grooves 13 penetrating through the top wall of the insertion space 11 along an up-down direction and arranged transversely. Upper portions of rear ends of the plurality of the first terminal grooves 13 extend rearward and penetrate through the rear surface of the insulating housing 10 to form the plurality of the upper adjusting slots 131 penetrating through the rear surface of the insulating housing 10. A bottom of each of the plurality of the upper adjusting slots 131 extends downward to form a first fixing slot 132. Lower portions of rear ends of the plurality of the second terminal grooves 12 extend rearward and then extend downward to form the plurality of the inverted L-shaped lower adjusting slots 121. Lower portions of rear ends of the plurality of the second terminal grooves 12 extend rearward and then extend downward to form the plurality of the lower adjusting slots 121 penetrating through the bottom surface of the insulating housing 10. A top of a front of each of the lower adjusting slots 121 extends upward to form a second fixing slot 122.

A lower portion of the rear surface of the insulating housing 10 protrudes rearward to form a rear portion 14. A rear of a top surface of the rear portion 14 is recessed downward to form a lacking groove 141. A rear of the lacking groove 141 is wider than a front of the lacking groove 141. Several portions of a rear surface of the rear portion 14 are recessed frontward to form a plurality of first adjusting channels 143 communicated with the lacking groove 141 and arranged transversely. Several portions of a front of the top surface of the rear portion 14 are recessed downward to form a plurality of second adjusting channels 142 communicated with the lacking groove 141 and arranged transversely. The plurality of the first adjusting channels 143 are arranged transversely.

Referring to FIG. 1 to FIG. 4, the plurality of the first terminals 20 are disposed in the plurality of the first terminal grooves 13 and are arranged transversely in the insulating housing 10. Each of the plurality of the first terminals 20 of the conductive terminals 101 has a first fastening portion 21 received in the insulating housing 10, a first contact portion 22 connected with a front end of the first fastening portion 21 and arranged at one side of the insertion space 11, an adjusting portion 24 connected with and extended downward from a rear end of the first fastening portion 21, and a first soldering portion 26 extended rearward from a tail end of the adjusting portion 24 and exposed out of the insulating housing 10. The adjusting portion 24 projects out from the rear surface of the insulating housing 10. Preferably, the first contact portions 22 of the plurality of the first terminals 20 are disposed to an upper side of the insertion space 11. The adjusting portion 24 opens an opening 25. The first contact portion 22 has a first elastic arm 221 extended frontward and downward from the front end of the first fastening portion 21, and a first touching arm 222 slantwise extended frontward and upward from a tail end of the first elastic arm 221. A bottom of the first fastening portion 21 protrudes downward to form a first fixing portion 23.

The rear end of the first fastening portion 21 extends downward, then slantwise extends downward and rearward and further extends downward to form the adjusting portion 24. The adjusting portion 24 has a first bar 241 extended downward from the rear end of the first fastening portion 21, an inclined portion 242 slantwise extended rearward and downward from a rear end of the first bar 241, and a second bar 243 extended downward from a tail end of the inclined portion 242. The inclined portion 242 is of a plate shape and is disposed along the up-down direction. The inclined portion 242 of the adjusting portion 24 opens the opening 25. The opening 25 is of an oval shape. A tail end of the second bar 243 protrudes rearward to form the first soldering portion 26. Specially, the adjusting portion 24 is connected between the first fastening portion 21 and the first soldering portion 26 for tuning impedances of the plurality of the first terminals 20. A width of the inclined portion 242 of the adjusting portion 24 is wider than a width of the first bar 241, a width of the second bar 243, a width of the first fastening portion 21, a width of the first contact portion 22 and a width of the first soldering portion 26.

Each conductive terminal 101 of the electrical connector 100 is fastened in the electrical connector 100. Specifically, the first fastening portions 21 of the plurality of the first terminals 20 are assembled in the plurality of the upper adjusting slots 131. The first fixing portion 23 of each of the plurality of the first terminals 20 is fixed in the first fixing slot 132. The first contact portions 22 of the plurality of the first terminals 20 are assembled in the plurality of the first terminal grooves 13 and project downward into the insertion space 11. The first elastic arms 221 and the first touching arms 222 of the plurality of the first terminals 20 are assembled in the plurality of the first terminal grooves 13 and project downward into the insertion space 11. The plurality of the first adjusting channels 143 are communicated with the lacking groove 141 and arranged transversely for receiving the second bars 243 of the plurality of the first terminals 20. The second bars 243 of bottom ends of the adjusting portions 24 of the plurality of the first terminals 20 are assembled in the plurality of the first adjusting channels 143. Front ends of the inclined portions 242 of the plurality of the first terminals 20 are assembled in the plurality of the second adjusting channels 142. Rear ends of the inclined portions 242 of the plurality of the first terminals 20 are assembled in the lacking groove 141. The first soldering portions 26 of the plurality of the first terminals 20 are exposed downward beyond a rear end of a bottom surface of the rear portion 14.

Referring to FIG. 1 to FIG. 4, the plurality of the second terminals 30 are disposed in the plurality of the second terminal grooves 12 and are arranged transversely in the insulating housing 10. Each of the plurality of the second terminals 30 has a second fastening portion 31 received in the insulating housing 10, a second contact portion 32 connected with a front end of the second fastening portion 31 and arranged at the other side of the insertion space 11, and a second soldering portion 34 extended downward and then extended rearward from a rear end of the second fastening portion 31. And the second soldering portion 34 of each of the plurality of the second terminals 30 is exposed out of the insulating housing 10. Preferably, the second contact portions 32 of the plurality of the second terminals 30 are disposed to a lower side of the insertion space 11 and spaced from the first contact portions 22 of the plurality of the first terminals 20. The second contact portion 32 has a second elastic arm 321 extended frontward and upward from the front end of the second fastening portion 31, and a second touching arm 322 slantwise extended frontward and downward from a tail end of the second elastic arm 321. A top of the second fastening portion 31 protrudes upward to form a second fixing portion 33.

The plurality of the second terminals 30 partially project into the insertion space 11. Specifically, the second fastening portions 31 of the plurality of the second terminals 30 are assembled in upper portions of the plurality of the lower adjusting slots 121. The second fixing portion 33 of each of the plurality of the second terminals 30 is fixed in the second fixing slot 122. The second contact portions 32 of the plurality of the second terminals 30 are disposed in the plurality of the second terminal grooves 12 and project upward into the insertion space 11. The second elastic arms 321 and the second touching arms 322 of the plurality of the second terminals 30 are disposed in the plurality of the second terminal grooves 12 and project upward into the insertion space 11. The second soldering portions 34 of the plurality of the second terminals 30 are exposed downward beyond a front end of the bottom surface of the rear portion 14.

Figure 5:
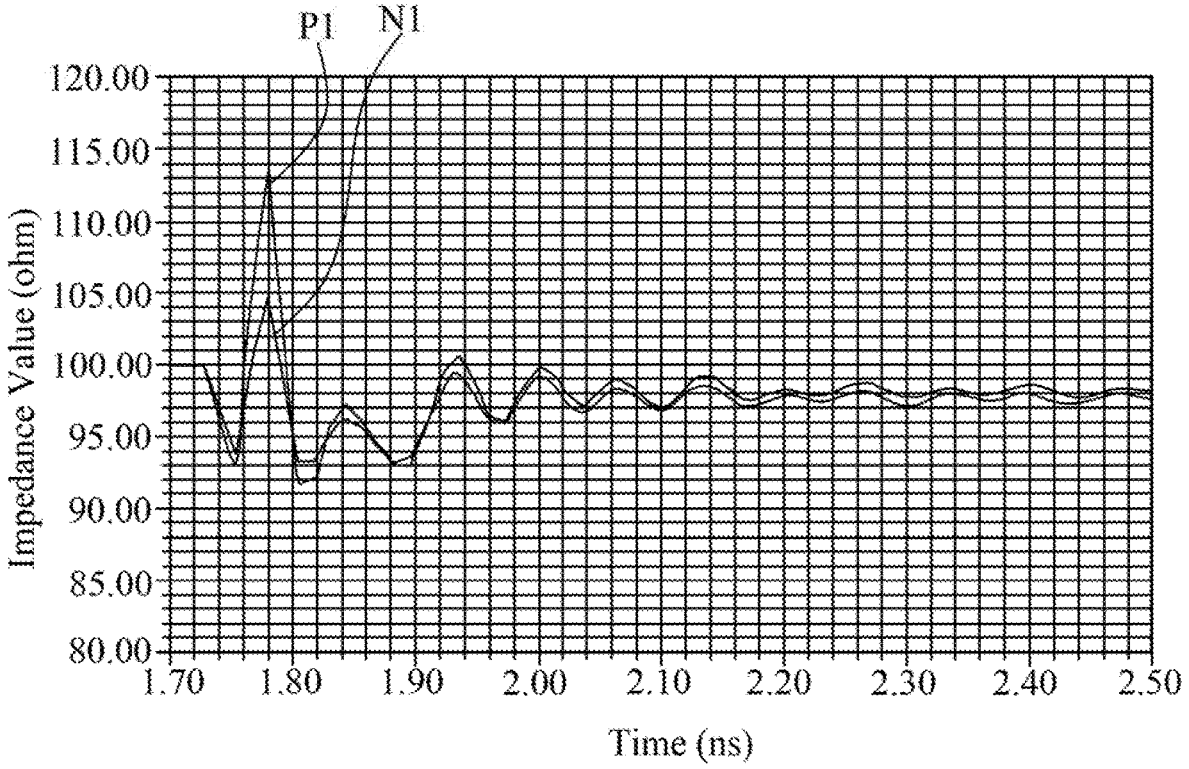
FIG. 5 (Prior Art)
FIG. 5 is a wave graph of simulation impedances of a plurality of first terminals of a conventional electrical connector in prior art and a plurality of first terminals of the electrical connector of FIG. 1, wherein a curve P1 of the simulation impedances of the plurality of the first terminals of the conventional electrical connector in the prior art is compared with a curve N1 of the simulation impedances of the plurality of the first terminals of the electrical connector of FIG. 1.
Figure 6:
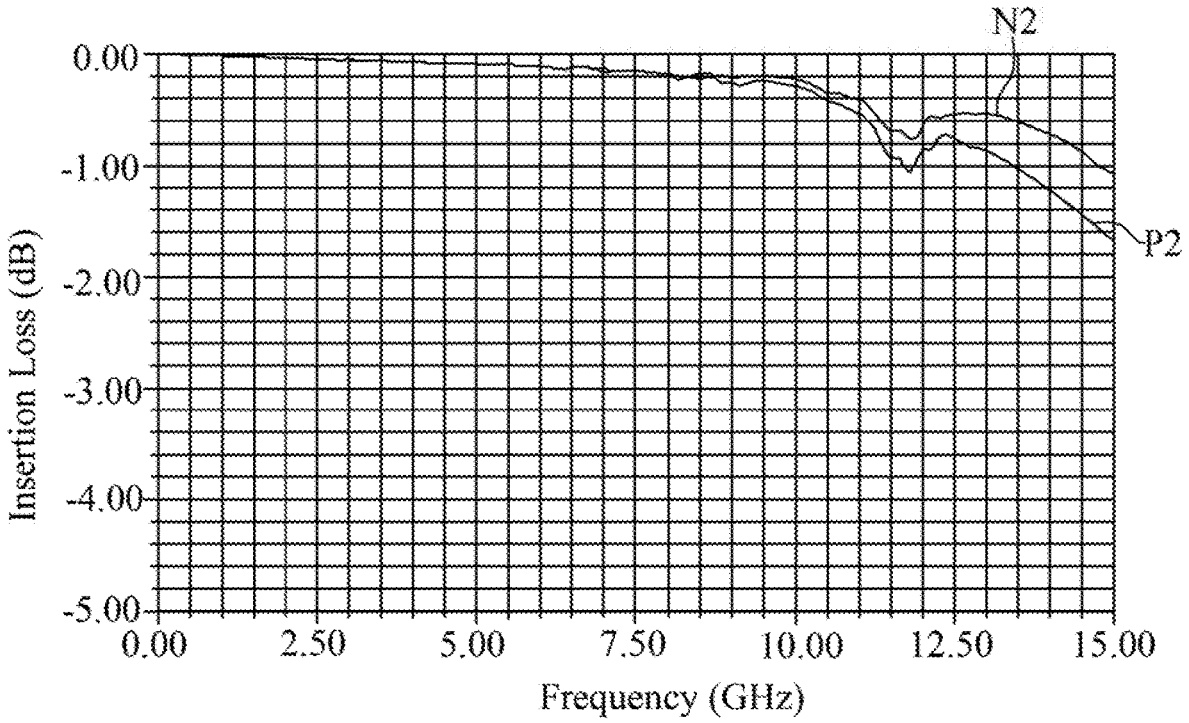
FIG. 6 (Prior Art)
FIG. 6 is a wave graph of simulation insertion losses of the conventional electrical connector in the prior art and the electrical connector of FIG. 1, wherein a curve P2 of the simulation insertion losses of the conventional electrical connector in the prior art is compared with a curve N2 of the simulation insertion losses of the electrical connector of FIG. 1.
Figure 7:
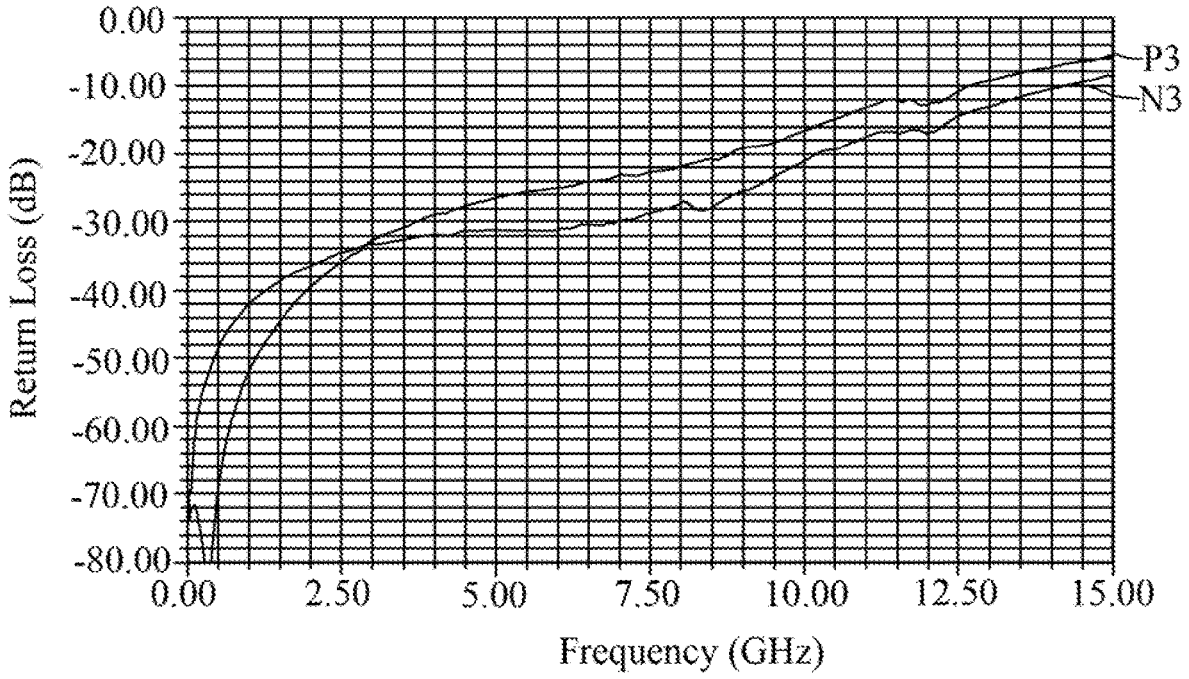
FIG. 7 (Prior Art)
FIG. 7 is a wave graph of simulation return losses of the conventional electrical connector in the prior art and the electrical connector of FIG. 1, wherein a curve P3 of the simulation return losses of the conventional electrical connector in the prior art is compared with a curve N3 of the simulation return losses of the electrical connector of FIG. 1.
Figure 8:
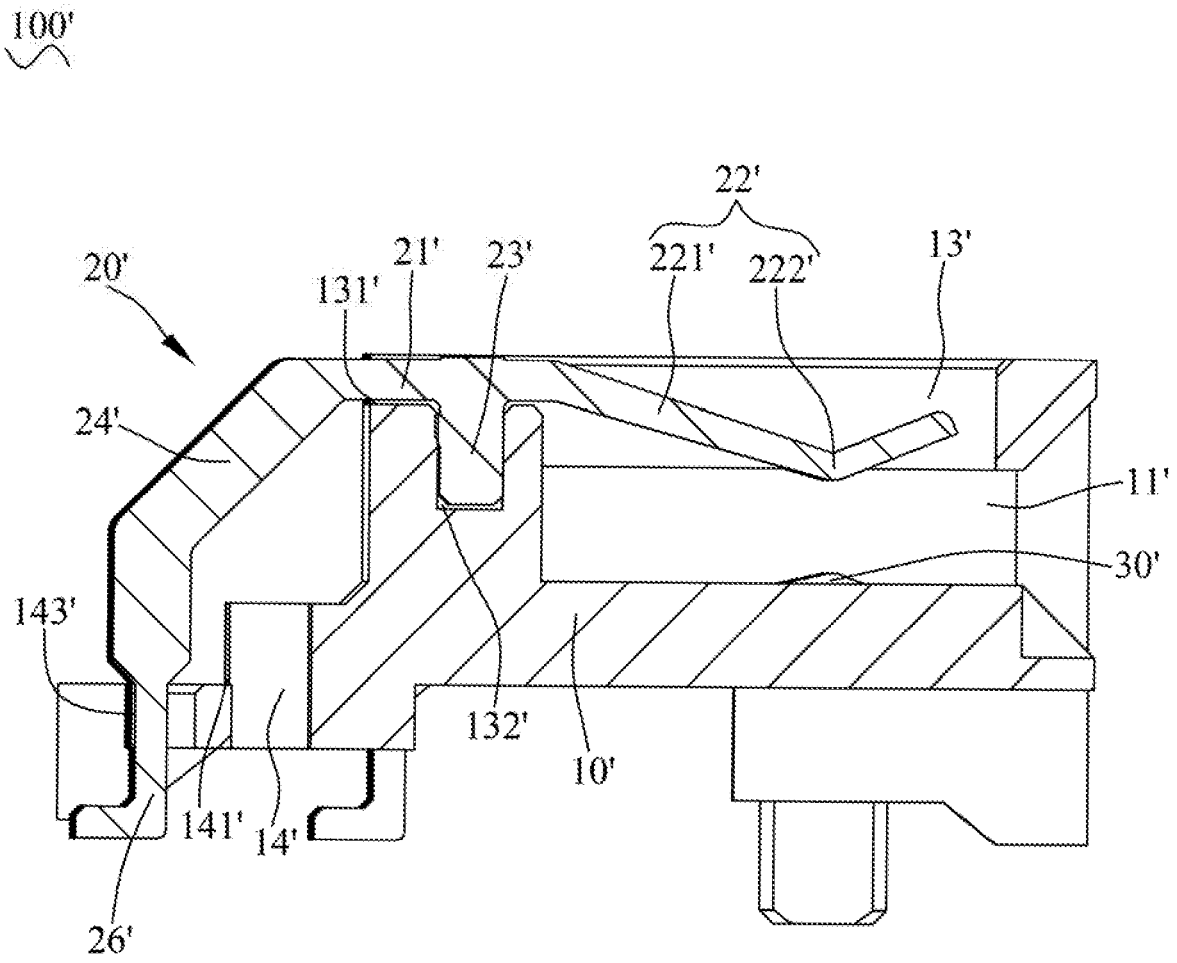
FIG. 8 (Prior Art)
FIG. 8 is a cross-sectional view of the conventional electrical connector in the prior art.

Referring to FIG. 1 to FIG. 8, a wave graph of simulation impedances of the plurality of the first terminals 20' of the conventional electrical connector 100' in prior art and the plurality of the first terminals 20 of the electrical connector 100 is shown in FIG. 5. A curve P1 shown in FIG. 5 indicates the simulation impedances of the plurality of the first terminals 20' of the conventional electrical connector 100' in the prior art. A curve N1 shown in FIG. 5 indicates the simulation impedances of the plurality of the first terminals 20 of the electrical connector 100. The curve P1 is compared with the curve N1. A wave graph of simulation insertion losses of the conventional electrical connector 100' in the prior art and the electrical connector 100 is shown in FIG. 6. A curve P2 shown in FIG. 6 indicates the simulation insertion losses of the conventional electrical connector 100' in the prior art. A curve N2 shown in FIG. 6 indicates the simulation insertion losses of the electrical connector 100. The curve P2 is compared with the curve N2. A wave graph of simulation return losses of the conventional electrical connector 100' in the prior art and the electrical connector 100 is shown in FIG. 7. A curve P3 shown in FIG. 7 indicates the simulation return losses of the conventional electrical connector 100' in the prior art. A curve N3 shown in FIG. 7 indicates the simulation return losses of the electrical connector 100. The curve P3 is compared with the curve N3.

Comparing with the prior art, a maximum difference between an input impedance and an output impedance of the plurality of the first terminals 20 of the electrical connector 100 and a minimum difference between the input impedance and the output impedance of the plurality of the first terminals 20 of the electrical connector 100 are both within 10Ω and conform to a scope specified by the QSFP electrical connector. In addition, the insertion losses of the electrical connector 100 are lower than the insertion losses of the conventional electrical connector 100' in the prior art. The return losses of the electrical connector 100 are less than the return losses of the conventional electrical connector 100' in the prior art. Namely, when a transmitter and a receiver are transmitted between each other, a signal weakening extent is lower, and an extent of a reflected electrical signal generated at the time of signals arriving at the transmitter and the receiver is lower, so interferences of the electrical signal afforded at the time of the electrical signal being transmitted are lowered, so that the electrical signal has a better transmission capacity.

As described above, because the adjusting portions 24 of the plurality of the first terminals 20 of the electrical connector 100 are designed to open the openings 25, the impedances of the plurality of the first terminals 20 conform to the scope specified by the electrical connector 100 which is the quad small form-factor pluggable electrical connector through simulation results of high-frequency analyses, and the insertion losses and return losses of the electrical connector 100 are optimized, so that the electrical connector 100 is capable of passing through a high-frequency requirement, and having a stabler and more effective electrical characteristic.

What is claimed is:

1. An electrical connector, comprising:

an insulating housing, a middle of a front surface of the insulating housing being recessed rearward to form an insertion space, the insulating housing opening a plurality of first terminal grooves penetrating through a top of the insulating housing and arranged transversely, the insulating housing defining a plurality of upper adjusting slots penetrating through a rear surface of the insulating housing and located behind the plurality of the first terminal grooves, each of the plurality of the upper adjusting slots being corresponding to one of the plurality of the first terminal grooves, a bottom of each of the plurality of the upper adjusting slots extending downward to form a first fixing slot, the plurality of the first terminal grooves being communicated between the insertion space and an outside, a lower portion of the rear surface of the insulating housing protruding rearward to form a rear portion, several portions of a rear surface of the rear portion being recessed frontward to form a plurality of first adjusting channels arranged transversely; and a plurality of first terminals disposed in the plurality of the first terminal grooves and arranged transversely, each of the plurality of the first terminals having a first fastening portion, and a first contact portion connected with a front end of the first fastening portion, a bottom of the first fastening portion protruding downward to form a first fixing portion, a rear end of the first fastening portion extending downward to form an adjusting portion, the adjusting portion opening an opening, a tail end of the adjusting portion extending rearward to form a first soldering portion, the first fastening portions of the plurality of the first terminals being assembled in the plurality of the upper adjusting slots, the first fixing portion of each of the plurality of the first terminals being fixed in the first fixing slot, the first contact portions of the plurality of the first terminals being assembled in the plurality of the first terminal grooves and projecting downward into the insertion space, bottom ends of the adjusting portions of the plurality of the first terminals being assembled in the plurality of the first adjusting channels, the first soldering portions of the plurality of the first terminals being exposed downward beyond a rear end of a bottom surface of the rear portion;

wherein the adjusting portion has a first bar extended downward from the rear end of the first fastening portion, an inclined portion slantwise extended rearward and downward from a rear end of the first bar, and a second bar extended downward from a tail end of the inclined portion, the inclined portion opens the opening.

2. The electrical connector as claimed in claim 1, wherein the insulating housing opens a plurality of second terminal grooves penetrating through a bottom of the insulating housing and arranged transversely, the electrical connector further includes a plurality of the second terminals disposed in the plurality of the second terminal grooves and are arranged transversely, the plurality of the second terminals partially project into the insertion space.

3. The electrical connector as claimed in claim 2, wherein the insulating housing defines a plurality of lower adjusting slots penetrating through a bottom surface of the insulating housing and located behind the plurality of the second terminal grooves, each of the plurality of the second terminals has a second fastening portion, a second contact portion connected with a front end of the second fastening portion, and a second soldering portion extended downward and then extended rearward from a rear end of the second fastening portion, the second fastening portions of the plurality of the second terminals are assembled in upper portions of the plurality of the lower adjusting slots, the second contact portions of the plurality of the second terminals are disposed in the plurality of the second terminal grooves and project upward into the insertion space, the second soldering portions of the plurality of the second terminals are exposed downward beyond a front end of the bottom surface of the rear portion.

4. The electrical connector as claimed in claim 3, wherein a top of a front of each of the lower adjusting slots extends upward to form a second fixing slot, a top of the second fastening portion protrudes upward to form a second fixing portion, the second fixing portion of each of the plurality of the second terminals is fixed in the second fixing slot.

5. The electrical connector as claimed in claim 3, wherein the second contact portion has a second elastic arm extended frontward and upward from the front end of the second fastening portion, and a second touching arm slantwise extended frontward and downward from a tail end of the second elastic arm, the second elastic arms and the second touching arms of the plurality of the second terminals are disposed in the plurality of the second terminal grooves and project upward into the insertion space.

6. The electrical connector as claimed in claim 1, wherein the first contact portion has a first elastic arm extended frontward and downward from the front end of the first fastening portion, and a first touching arm slantwise extended frontward and upward from a tail end of the first elastic arm, the first elastic arms and the first touching arms of the plurality of the first terminals are assembled in the plurality of the first terminal grooves and project downward into the insertion space.

7. The electrical connector as claimed in claim 1, wherein a rear of a top surface of the rear portion is recessed downward to form a lacking groove, several portions of a front of the top surface of the rear portion are recessed downward to form a plurality of second adjusting channels communicated with the lacking groove and arranged transversely, the second bars of the plurality of the first terminals are assembled in the plurality of the first adjusting channels, front ends of the inclined portions of the plurality of the first terminals are assembled in the plurality of the second adjusting channels.

8. The electrical connector as claimed in claim 1, wherein the opening is of an oval shape.

9. The electrical connector as claimed in claim 1, wherein the electrical connector is a quad small form-factor pluggable electrical connector.

10. A conductive terminal of an electrical connector, the conductive terminal being fastened in the electrical connector, the conductive terminal comprising:

a first fastening portion, a bottom of the first fastening portion protruding downward to form a first fixing portion;

a first contact portion connected with a front end of the first fastening portion;

an adjusting portion extended downward, then slantwise extended downward and rearward and further extended downward from a rear end of the first fastening portion, the adjusting portion opening an opening; and a first soldering portion extended rearward from a tail end of the adjusting portion;

wherein the adjusting portion has a first bar extended downward from the rear end of the first fastening portion, an inclined portion slantwise extended rearward and downward from a rear end of the first bar, and a second bar extended downward from a tail end of the inclined portion, the inclined portion opens the opening.

11. The conductive terminal as claimed in claim 10, wherein the first contact portion has a first elastic arm extended frontward and downward from the front end of the first fastening portion, and a first touching arm slantwise extended frontward and upward from a tail end of the first elastic arm.

12. The conductive terminal as claimed in claim 10, wherein the opening is of an oval shape.

13. The conductive terminal as claimed in claim 10, wherein the electrical connector is a quad small form-factor pluggable electrical connector.

14. An electrical connector, comprising:

an insulating housing, a middle of a front surface of the insulating housing being recessed rearward to form an insertion space;

a plurality of first terminals arranged transversely in the insulating housing, each of the plurality of the first terminals having:

a first fastening portion received in the insulating housing;

a first contact portion connected with a front end of the first fastening portion and arranged at one side of the insertion space;

an adjusting portion extended downward from a rear end of the first fastening portion, the adjusting portion opening an opening; and a first soldering portion extended rearward from a tail end of the adjusting portion and exposed out of the insulating housing; and a plurality of second terminals arranged transversely in the insulating housing, each of the plurality of the second terminals having:

a second fastening portion received in the insulating housing;

a second contact portion connected with a front end of the second fastening portion and arranged at the other side of the insertion space; and a second soldering portion extended from a rear end of the second fastening portion and exposed out of the insulating housing;

wherein the adjusting portion has a first bar extended downward from the first fastening portion, an inclined portion slantwise extended rearward and downward from the first bar, and a second bar extended downward from the inclined portion, the inclined portion opens the opening.

15. The electrical connector as claimed in claim 14, wherein a width of the inclined portion is wider than a width of the first bar and a width of the second bar.

16. The electrical connector as claimed in claim 14, wherein the opening is of an oval shape.

17. The electrical connector as claimed in claim 14, wherein the adjusting portion projects out from a rear surface of the insulating housing.

18. The electrical connector as claimed in claim 14, wherein a lower portion of a rear surface of the insulating housing protrudes rearward to form a rear portion, several portions of a rear surface of the rear portion are recessed frontward to form a plurality of first adjusting channels arranged transversely for receiving the second bars of the plurality of the first terminals.

19. The electrical connector as claimed in claim 18, wherein a rear of a top surface of the rear portion is recessed downward to form a lacking groove, several portions of a front of the top surface of the rear portion are recessed downward to form a plurality of second adjusting channels communicated with the lacking groove and arranged transversely, front ends of the inclined portions of the plurality of the first terminals are assembled in the plurality of the second adjusting channels.

* * * * *